US010651027B2

(12) United States Patent
Nagata et al.

(10) Patent No.: US 10,651,027 B2
(45) Date of Patent: May 12, 2020

(54) LIGHT-EMITTING DEVICE AND LIGHT SOURCE APPARATUS

(71) Applicant: HAMAMATSU PHOTONICS K.K., Hamamatsu-shi, Shizuoka (JP)

(72) Inventors: Takaaki Nagata, Hamamatsu (JP); Takeo Fujii, Hamamatsu (JP); Motohiro Suyama, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 16/507,251

(22) Filed: Jul. 10, 2019

(65) Prior Publication Data

US 2020/0020519 A1 Jan. 16, 2020

(30) Foreign Application Priority Data

Jul. 12, 2018 (JP) ..... 2018-132509

(51) Int. Cl.
*H01K 1/06* (2006.01)
*H01K 1/16* (2006.01)
*H01K 1/28* (2006.01)

(52) U.S. Cl.
CPC ..... *H01K 1/06* (2013.01); *H01K 1/16* (2013.01); *H01K 1/28* (2013.01)

(58) Field of Classification Search
CPC .. H01K 1/06; H01K 1/16; H01K 1/28; H01K 1/02; H01L 1/02; H01L 33/0054; H01L 33/36; H01L 33/40; H01L 33/641; H01L 2933/0016; H01L 2933/0075
See application file for complete search history.

(56) References Cited

U.S. PATENT DOCUMENTS

2017/0294629 A1 10/2017 Kim et al.

FOREIGN PATENT DOCUMENTS

JP 2014-67544 A 4/2014

*Primary Examiner* — Joseph L Williams
*Assistant Examiner* — Jose M Diaz
(74) *Attorney, Agent, or Firm* — Faegre Drinker Biddle & Reath LLP

(57) ABSTRACT

A light-emitting device includes: a substrate having a groove extending in a first direction and a first surface and a second surface respectively arranged to sandwich the groove in a second direction; a first electrode provided on the first surface; a second electrode provided on the second surface; a graphite thin film provided on the first electrode and the second electrode and extending from the first electrode to the second electrode along the second direction in such a way as to be astride the groove; a third electrode provided on the graphite thin film in such a way as to be opposite the first electrode via the graphite thin film; and a fourth electrode provided on the graphite thin film in such a way as to be opposite the second electrode via the graphite thin film.

9 Claims, 6 Drawing Sheets

LIGHT-EMITTING DEVICE AND LIGHT SOURCE APPARATUS

TECHNICAL FIELD

The present invention relates to a light-emitting device and a light source apparatus.

BACKGROUND

A light-emitting device employing a graphite thin film (e.g., a single layer or multiple layers of graphene) is known (see, for example, Patent Documents 1 and 2). In such a light-emitting device, a voltage is applied to the graphite thin film, whereby infrared light is emitted from the graphite thin film.

SUMMARY

In the structure disclosed in Patent Document 1 (Japanese Unexamined Patent Publication No. 2014-67544), a graphite thin film is used as a filament, and the graphite thin film is accommodated in an accommodation member, which is tightly closed to the exterior to thereby place its interior in a vacuum state. In this structure, when a gas contained in the graphite thin film is emitted, the degree of vacuum in the accommodation member is not maintained, and there is a risk of the light emission efficiency being deteriorated. In the structure disclosed in Patent Document 2 (U.S. Patent Publication No. 2017/0294629), a graphite thin film is set in position on a substrate in which a groove is previously formed, and each edge portion of the graphite thin film is bonded to a gold electrode on the substrate. In such a structure, there are cases where the portion of the graphite thin film bridging the groove is used as a light-emitting portion, and it is desired that the bridging portion should be efficiently heated.

Thus, according to an aspect of the present invention, it is an object to provide a light-emitting device and a light source apparatus that are capable of mitigating the influence of an emission gas from the graphite thin film and of efficiently heating the bridging portion of the graphite thin film.

A light-emitting device according to an aspect of the present invention includes: a substrate having a groove extending in a first direction and a first surface and a second surface respectively arranged to sandwich the groove in a second direction crossing the first direction; a first electrode provided on the first surface; a second electrode provided on the second surface; a graphite thin film provided on the first electrode and the second electrode and extending from the first electrode to the second electrode along the second direction in such a way as to be astride the groove; a third electrode electrically connected to the first electrode and provided on the graphite thin film in such a way as to be opposite the first electrode via the graphite thin film; and a fourth electrode electrically connected to the second electrode and provided on the graphite thin film in such a way as to be opposite the second electrode via the graphite thin film.

In a light-emitting device according to an aspect of the present invention, the graphite thin film is provided on the first surface and the second surface on either side of the groove via the first electrode and the second electrode in such a way as to be astride the groove formed in the substrate. Further, the portion of the graphite thin film opposite the first electrode and the second electrode is covered with the third electrode and the fourth electrode. In this structure, an electric current flows through the graphite thin film mainly from one end on the groove side of the first electrode and the third electrode toward one end on the groove side of the second electrode and the fourth electrode, so that the electric current mainly flows through the bridging portion and the portion of the graphite thin film in the vicinity of the bridging portion. Due to the third electrode and the fourth electrode covering the graphite thin film, the emission of a gas contained in the graphite thin film is suppressed at the surface of the graphite thin film. As a result, it is possible to mitigate the influence of the emission gas from the graphite thin film and to efficiently heat the light-emitting portion of the graphite thin film.

The graphite thin film may be multilayer graphene the number of layers of which ranges from 50 to 2000. To enhance the light-emission intensity, it is desirable for the number of layers of the graphite thin film to be large. On the other hand, from the viewpoint of achieving an improvement in terms of thermal response rate, it is desirable for the number of layers of the graphite thin film to be small so that the heat capacity of the graphite thin film may be reduced. By setting the number of layers of the graphite thin film 50 to 2000, it is possible to provide a light-emitting device suitable from the above points of view.

One end on the groove side of the first electrode may be situated further on the groove side than one end on the groove side of the third electrode, and one end on the groove side of the second electrode may be situated further on the groove side than one end on the groove side of the fourth electrode. In this structure, the distance between the first electrode and the second electrode via the graphite thin film is shorter than the distance between the third electrode and the fourth electrode via the graphite thin film. As a result, it is possible to adjust the magnitude relationship between the value of the electric current flowing between the first electrode and the second electrode via the graphite thin film and the value of the electric current flowing between the third electrode and the fourth electrode via the graphite thin film.

The first electrode may extend at least to a border line between the first surface and the groove, and the second electrode may extend at least to a border line between the second surface and the groove. In this structure, the electric current mainly flows through the bridging portion of the graphite thin film. As a result, it is possible to heat the bridging portion of the graphite thin film more efficiently.

The substrate may have a base member formed of silicon, and an oxide layer formed of a material containing an oxide. The oxide layer may be arranged at least between the base member and the first electrode and between the base member and the second electrode. In this structure, due to the oxide layer formed of a material containing an oxide, it is possible to secure insulation between the first electrode and the second electrode via the base member.

The third electrode and the fourth electrode may respectively have an outermost surface layer, and an intermediate layer arranged between the outermost surface layer and the graphite thin film, and the resistance value of the outermost surface layer may be smaller than the resistance value of the intermediate layer, the first electrode, and the second electrode. In this structure, it is possible to cause an electric current to flow mainly through the outermost surface layers of the third electrode and the fourth electrode to which a connection line for supplying an electric current from the outside can be connected most easily.

The outermost surface layer may be formed of gold. The intermediate layer may include a first layer formed of titanium and a second layer formed of platinum. The first layer may be provided on the graphite thin film, and the second layer may be arranged between the first layer and the outermost surface layer. In this structure, it is possible to reduce the contact resistance with respect to the graphite thin film since the first layer is formed of titanium. Further, due to the intermediation of the second layer formed of platinum, it is possible to improve the bonding property of the outermost surface layer with respect to the first layer.

The first electrode and the second electrode may respectively have a third layer formed of titanium and a fourth layer formed of platinum. The third layer may be provided on the substrate, and the fourth layer may be arranged between the third layer and the graphite thin film. For example, the graphite thin film is transferred to the substrate in the state in which the first electrode and the second electrode have been formed thereon, whereby the graphite thin film is formed on the first electrode and the second electrode. In this structure, the first layer formed of titanium is covered with the second layer formed of platinum, so that it is possible to suppress oxidation of the first electrode and the second electrode when transferring the graphite thin film to the substrate.

A light source apparatus according to another aspect of the present invention is equipped with the above-described light-emitting device and a package having a light-transmitting window and forming an inner space maintained in a vacuum state, and the light-emitting device is arranged in the inner space of the package.

In the light source apparatus according to the other aspect of the present invention, the above-described light-emitting device is arranged in the inner space of the package maintained in a vacuum state. Due to the structure of the above-described light-emitting device, the gas emitted from the graphite thin film is suppressed, so that it is possible to reduce the possibility of the degree of vacuum of the inner space being reduced by the emission gas. As a result, the degree of vacuum of the inner space is maintained, and it is possible to suppress deterioration in light-emission efficiency.

According to an aspect of the present invention, it is possible to mitigate the influence of the emission gas from the graphite thin film and to efficiently heat the bridging portion of the graphite thin film.

DETAILED DESCRIPTION

Figure 1:
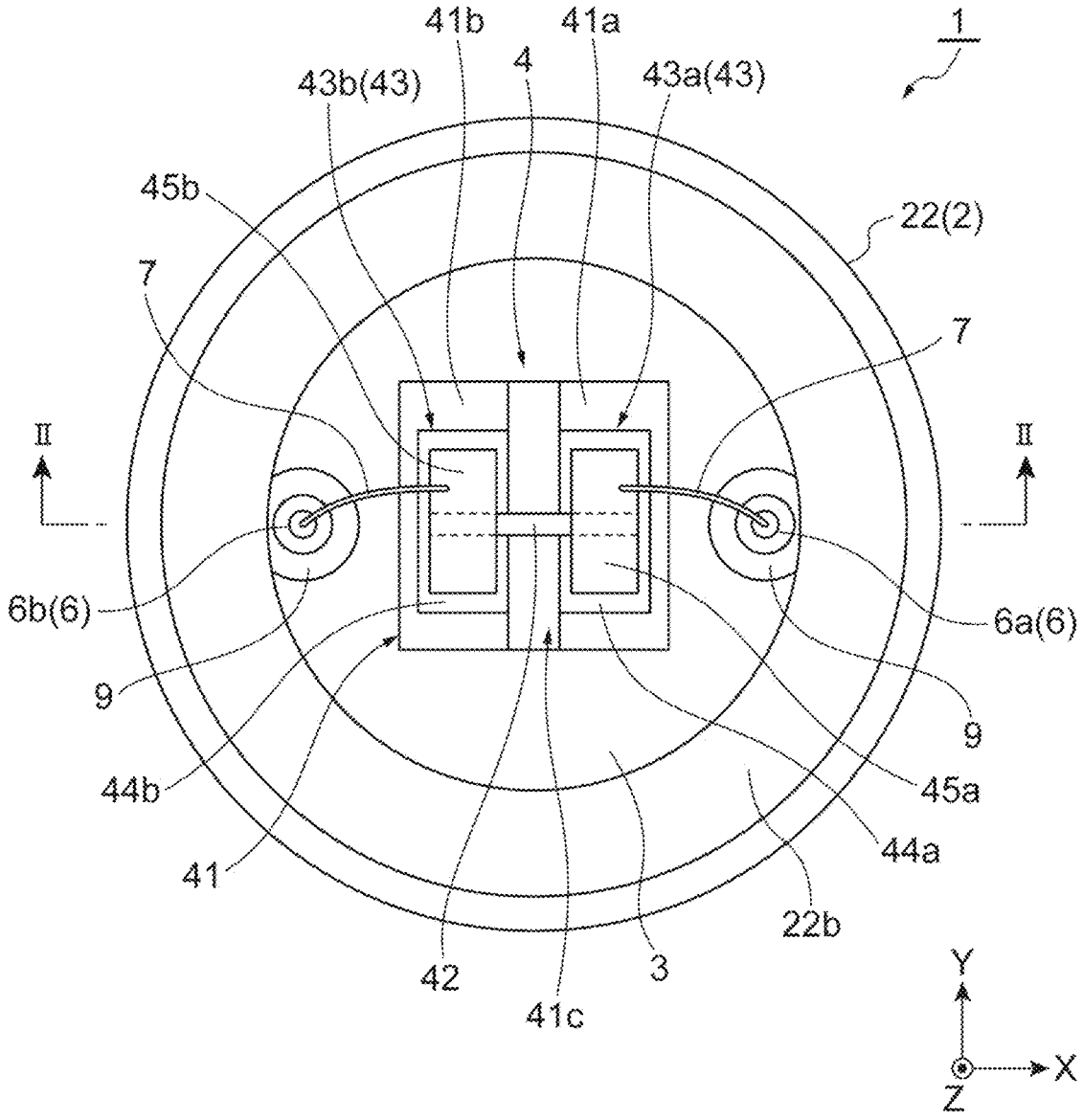
FIG. 1 is a plan view of a light source apparatus including a light-emitting device according to an embodiment.

In the following, an embodiment of the present invention will be described in detail with reference to the drawings. In the drawings, the same or equivalent portions are designated by the same reference numerals, and a redundant description thereof will be left out. The dimension or dimensional ratio of each member (or portion) shown in the drawings may be different from the actual dimension or dimensional ratio in order to facilitate the understanding of the illustration. In the drawings, an XYZ orthogonal coordinate system is given as needed.

Figure 2:
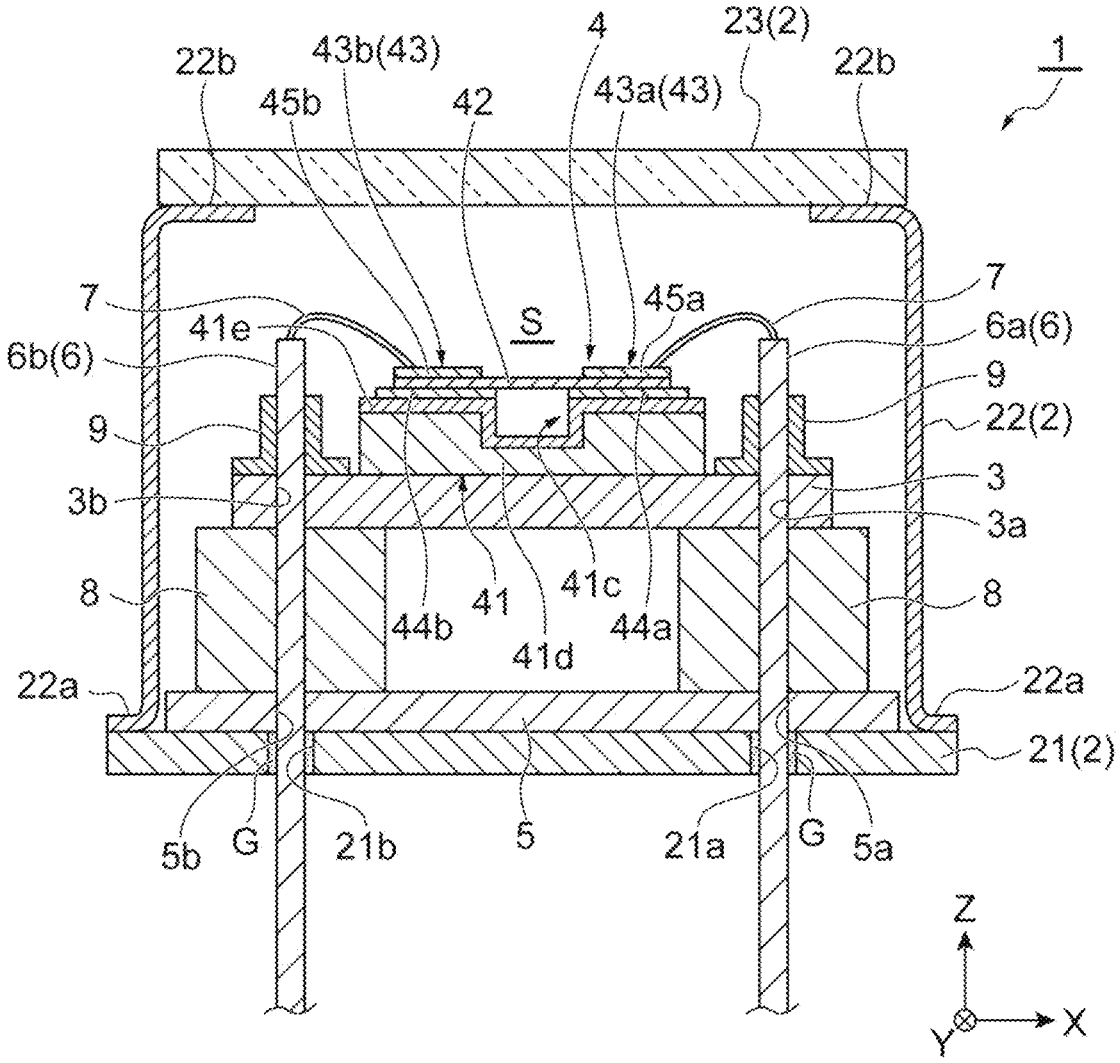
FIG. 2 is a sectional view taken along line II-II of FIG. 1.

The structure of a light source apparatus 1 according to an embodiment will be described with reference to FIGS. 1 and 2. FIG. 1 is a plan view of the light source apparatus 1 including a light-emitting device 4 according to an embodiment. FIG. 2 is a sectional view taken along line II-II of FIG. 1. In FIG. 1, a light-transmitting window 23 described below is omitted. As shown in FIGS. 1 and 2, the light source apparatus 1 is equipped with a package 2 forming an inner space S maintained in a vacuum state, a stem 3 arranged in the package 2, the light-emitting device 4 arranged on the stem 3, a base plate 5, stem pins 6, bonding wires 7, a spacer 8, and eyelets 9. The light-emitting device 4 is equipped with a substrate 41, a graphite thin film 42, and electrodes 43 (a source electrode 43*a* and a drain electrode 43*b*). In the following description, the words "up (upper)" and "down (lower)" are used by using as a reference the case in which the light source apparatus 1 is arranged such that the beam generated by the light source apparatus 1 (the light-emitting device 4) is emitted vertically upwards. Thus, depending upon the state of use of the light source apparatus 1 (the light-emitting device 4), a member designated by the word "up" is not always situated on the upper side in the vertical direction of a member designated by the word "down."

The package 2 has a disc-like base member 21 formed, for example, of metal, a cylindrical cap 22 formed, for example, of metal, and a light-transmitting window 23. The base member 21 and the cap 22 are bonded to each other in an airtight fashion in a state in which the edge portion of the base member 21 and a ring-like flange portion 22*a* of the cap 22 are held in contact with each other. The flange portion 22*a* is extending outwards along the base member 21. At the upper end portion of the cap 22 (the opposite end portion from the flange portion 22*a*), there is formed a ring-like flange portion 22*b* extending inwards.

The light-transmitting window 23 is formed in a disc-like configuration. The light-transmitting window 23 is formed of a material of high infrared light transmissivity such as CaF2 (calcium fluoride). The light-transmitting window 23 is fixed to the cap 22. More specifically, the light-transmitting window 23 is bonded in an airtight fashion to the upper surface (outer surface) of the flange portion 22*b* of the cap 22 in such a way as to close an opening formed by the flange portion 22*b* of the cap 22. As described above, the base member 21, the cap 22, and the light-transmitting window 23 are bonded to each other in an airtight fashion, whereby there is formed inside the package 2 an inner space S maintained in a vacuum state. The inner surface of the base member 21 (the surface adjacent to inner space S) is bonded to the base plate 5 which is formed of disc-like metal smaller than the base member 21.

The stem 3 is a disc-like member smaller than the base plate 5. The stem 3 is formed, for example, of a ceramic material. Formed in the stem 3, the base plate 5, and the base member 21 are a through-hole 3*a*, a through-hole 5*a*, and a through-hole 21*a* for the insertion of a stem pin 6*a*, and a through-hole 3*b*, a through-hole 5*b*, and a through-hole 21*b* for the insertion of a stem pin 6*b*. The through-hole 3*a*, the through-hole 5*a*, and the through-hole 21*a* are formed at positions overlapping each other as seen from the thickness direction of the stem 3 (the Z-axis direction). The through-hole 3*b*, the through-hole 5*b*, and the through-hole 21*b* are formed at positions overlapping each other as seen from the thickness direction of the stem 3. The through-holes for the insertion of the stem pin 6*a* (the through-hole 3*a*, the through-hole 5*a*, and the through-hole 21*a*) and the through-holes for the insertion of the stem pin 6*b* (the through-hole 3*b*, the through-hole 5*b*, and the through-hole 21*b*) are opposite each other in the direction (the X-axis direction) in which the source electrode 43*a* and the drain electrode 43*b* are opposite each other. More specifically, as seen from the Z-axis direction, the through-hole 3*a*, the through-hole 5*a*, and the through-hole 21*a* are situated outer than the source electrode 43*a*, and the through-hole 3*b*, the through-hole 5*b*, and the through-hole 21*b* are situated outer than the drain electrode 43*b*. That is, as seen from the Z-axis direction, the stem pin 6*a* is situated outer than the source electrode 43*a*, and the stem pin 6*b* is situated outer than the drain electrode 43*b*.

Each stem pin 6 is a conductive member, and, for example, is formed of Kovar metal with nickel plating (1 to 10 μm), gold plating (0.1 to 2 μm), etc. Each stem pin 6 extends in the Z-axis direction. The stem pins 6 and the through-holes 21*a* and 21*b* of the base member 21 are bonded to each other in an airtight fashion by a seal member G formed, for example, of low melting-point glass. The portion of each stem pin 6 protruding from the stem 3 and the stem 3 are fixed to each other via the eyelet 9. As a result, each stem pin 6 is fixed to the stem 3. The portion of the stem pin 6*a* extending out from the package 2 is connected to an external power source or the like (not shown). On the other hand, the portion of the stem pin 6*a* protruding from the stem 3 (in the present embodiment, the distal end of the stem pin 6*a*) is electrically connected the source electrode 43*a* via the bonding wire 7. As a result, electrical conduction between the source electrode 43*a* and the external power source is secured. Similarly, the portion of the stein pin 6*b* extending out from the package 2 is connected to an external power source or the like (not shown). On the other hand, the portion of the stem pin 6*b* protruding from the stem 3 (in the present embodiment, the distal end of the stem pin 6*b*) is electrically connected to the drain electrode 43*b* via the bonding wire 7. As a result, electrical conduction between the drain electrode 43*b* and the external power source is secured.

Between the stem 3 and the base plate 5, there is arranged a cylindrical spacer 8 in such a way as to surround each stem pin 6. The spacer 8 is formed, for example, of a ceramic material. Due to the spacer 8, the stein 3 is arranged at a position spaced away from the base plate 5.

The surface of the substrate 41 opposite from the surface where the graphite thin film 42 is provided is fixed to the upper surface of the stem 3 by die bonding or the like, whereby the light-emitting device 4 is fixed on the stem 3. Light emitted from the graphite thin film 42 of the light-emitting device 4 by applying a voltage to the graphite thin film 42 through the electrode 43 is emitted to the exterior of the package 2 via the light-transmitting window 23. The light-emitting device 4 (the light source apparatus 1) is an infrared light-emitting device emitting infrared light (infrared light source apparatus).

The structure of the light source apparatus 1 is not restricted to the above-described one. For example, while in the light source apparatus 1, the stem 3 is fixed in position by the two stem pins 6*a* and 6*b* opposite each other in the X-axis direction, three or more stem pins may be passed through the stem 3, the base plate 5, and the base member 21 in order to fix the stem 3 in position in a more stable manner.

Figure 3:
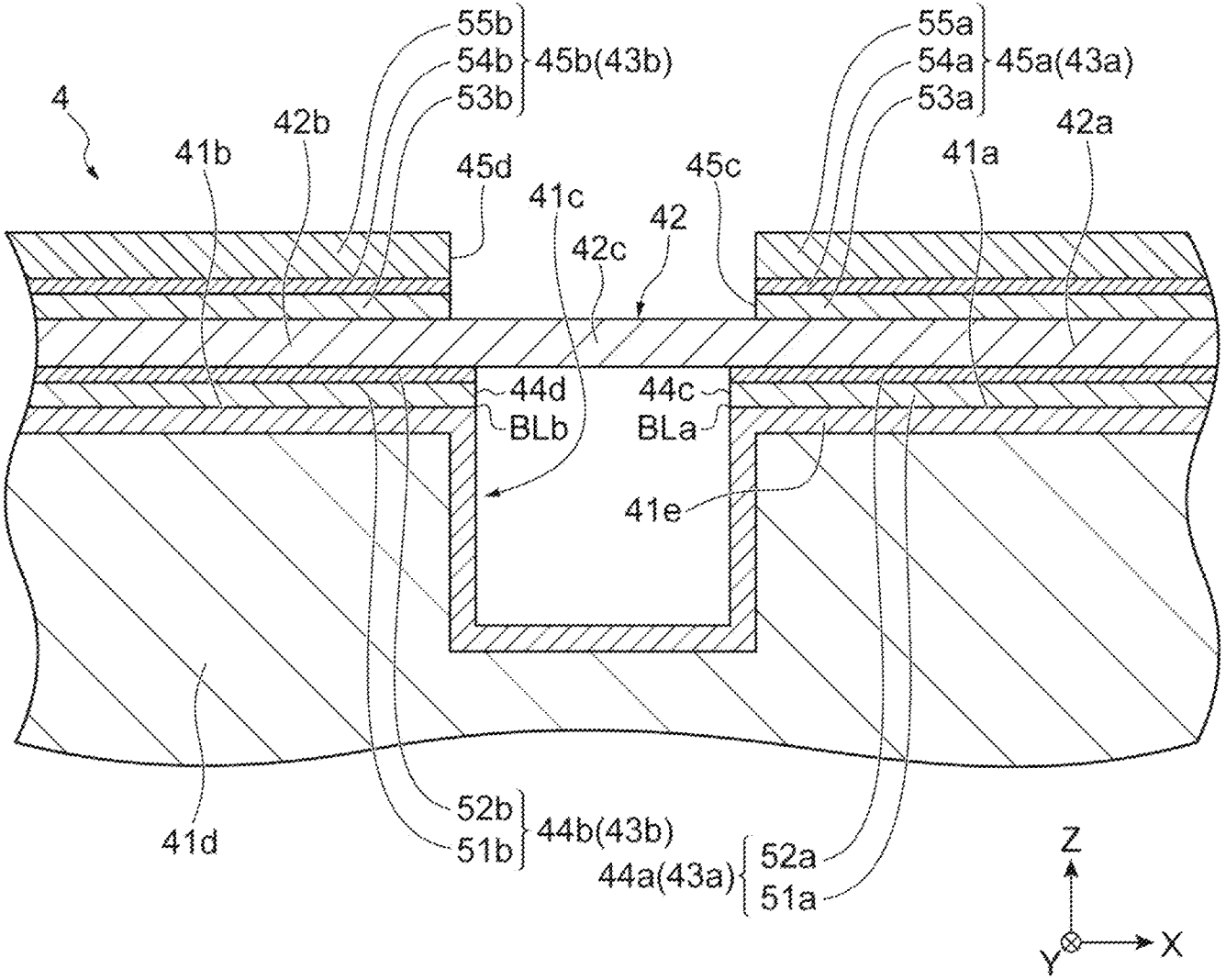
FIG. 3 is an enlarged view of a portion of the light-emitting device shown in FIG. 1.

Next, the structure of the light-emitting device 4 according to the present embodiment will be described in detail with reference to FIG. 3. FIG. 3 is an enlarged view of a portion of the light-emitting device 4 shown in FIG. 1. As shown in FIG. 3, the light-emitting device 4 has the substrate 41, the graphite thin film 42 arranged on the substrate 41 via a portion of the electrode 43, and the electrodes 43 (the source electrode 43*a* and the drain electrode 43*b*) covering a part of the graphite thin film 42.

The substrate 41 is formed as a rectangular plate. As seen from the Z-axis direction, the substrate 41 has a square configuration one side of which is, for example, approximately 5 mm. On the side opposite the side fixed to the upper surface of the stem 3, the substrate 41 has a surface 41*a* (first surface) and a surface 41*b* (second surface). On the side opposite the side fixed to the upper surface of the stem 3, the substrate 41 has a groove 41*c* extending in the Y-axis direction (first direction) (see FIG. 1). The sectional configuration of the groove 41*c* crossing the Y-axis direction is, for example, rectangular. The width of the groove 41*c* as seen from the Y-axis direction is, for example, approximately 100 μm to 300 μm, and the depth of the groove 41*c* is, for example, approximately 400 μm. By forming the groove 41*c* in the substrate 41, it is possible to suppress heat conduction from the graphite thin film 42 to the substrate 41 when, for example, the graphite thin film 42 emits light. In this way, in the substrate 41, the surface 41*a* and the surface 41*b* are respectively arranged in such a way as to be on either side of the groove 41*c* in the X-axis direction (second direction). The surface 41*a* and the surface 41*b* are disposed to sandwich the groove 41*c* in the X-axis direction. That is, the surface 41*a* and the surface 41*b* constitute the portion of the surface of the rectangular plate-like substrate 41 excluding the groove 41*c*. The positions in the Z-axis direction of the surface 41*a* and the surface 41*b* are substantially the same. The surface 41*a* is situated on the stem pin 6*a* side, and the surface 41*b* is situated on the stem pin 6*b* side.

In the present embodiment, the substrate 41 has a rectangular plate-like base member 41*d*, and an insulator layer 41*e* (oxide layer) provided on the surface of the base member 41*d*. The base member 41*d* is a silicon substrate formed of Si (silicon). The thickness of the base member 41*d* is, for example, approximately 1000 μm (1 mm). It is only necessary, however, for the base member 41*d* to be formed of a material having a sufficiently larger electrical resistance as compared with the graphite thin film 42 and enough not to electrically short between the source electrode 43*a* and the drain electrode 43*b*. The base member 41*d* may be formed of a material including SiN, SiC, Al2O3, MgO or the like. The insulator layer 41*e* is formed of a material containing an oxide such as SiO2 (silicon dioxide). The insulator layer 41*e* is coated on the surface of the base member 41*d*. The thickness of the insulator layer 41*e* is, for example, approximately 0.2 μm. In the present embodiment, the surface of a part of the insulator layer 41*e* constitutes the surface 41*a* and the surface 41*b*.

As seen from the Z-axis direction, the graphite thin film 42 is formed in a rectangular configuration sufficiently smaller than the substrate 41, and is arranged at substantially the center of the substrate 41 in the Y-axis direction. The width in the Y-axis direction of the graphite thin film 42 is, for example, 100 μm. The graphite thin film 42 extends along the X-axis direction, extending from the surface 41*a* to the surface 41*b* in such a way as to be astride the groove 41*c*. The graphite thin film 42 is a single layer or multiple layers of graphene (or graphite) the number of layers of which ranges, for example, from 1 to 2000. The film thickness of one layer of graphene is approximately 3.3 Å (0.33 nm). The graphite thin film 42 (graphene) is formed of carbon. The single layer or multiple layers of graphene constituting the material of the graphite thin film 42 can be prepared by, for example, transfer from graphite by an adhesive tape or the like, chemical vapor phase growth method, SiC heating method or the like.

The graphite thin film 42 functions as a light-emitting portion to which a voltage is applied by the electrode 43 and which is thereby heated to emit infrared light. Here, to achieve an improvement in terms of light-emission intensity, it is desirable for the number of layers of the graphite thin film 42 to be large. On the other hand, from the viewpoint of achieving an improvement in terms of thermal response rate, it is desirable for the number of layers of the graphite thin film 42 to be small so that the heat capacity of the graphite thin film 42 may be low. From the above viewpoints, the graphite thin film 42 may be a multilayers the number of layers of which is preferably 50 to 2000. By setting the number of layers of the graphite thin film 42 to 50 to 2000, it is possible to obtain a light-emitting device 4 suitable from the above points of view. The graphite thin film 42 has a supported portion 42*a* supported by the surface 41*a* side portion of the substrate 41, a supported portion 42*b* supported by the surface 41*b* side portion of the substrate 41, and a bridging portion 42*c* opposite the groove 41*c* (bridging the groove 41*c*).

The source electrode 43*a* is provided on the surface 41*a*, and covers the supported portion 42*a* of the graphite thin film 42. The drain electrode 43*b* is provided on the surface 41*b*, and covers the supported portion 42*b* of the graphite thin film 42. The source electrode 43*a* and the drain electrode 43*b* do not cover the bridging portion 42*c* of the graphite thin film 42, and the bridging portion 42*c* is exposed to the exterior of the light-emitting device 4. A space is formed between the bridging portion 42*c* and the surface of the groove 41*c*. The source electrode 43*a* and the drain electrode 43*b* are of a similar structure (symmetrical structure).

The source electrode 43*a* has a lower electrode 44*a* (first electrode) and an upper electrode 45*a* (third electrode). In the Z-axis direction, the lower electrode 44*a* and the upper electrode 45*a* are arranged opposite each other in such a way as to hold the graphite thin film 42 between them. In other words, on the substrate 41, there are provided the lower electrode 44*a*, the graphite thin film 42 (the supported portion 42*a*), and the upper electrode 45*a* in that order from the substrate 41 side. The upper electrode 45*a* and the lower electrode 44*a* are electrically connected to each other and maintained at the same potential.

The lower electrode 44*a* is provided on the surface 41*a*. The lower electrode 44*a* is formed in a rectangular configuration as seen from the Z-axis direction. The thickness of the lower electrode 44*a* is, for example, approximately 0.3 μm. Substantially at the center in the Y-axis direction of the lower electrode 44*a*, there is provided the supported portion 42*a* of the graphite thin film 42. Along the X-axis direction, the lower electrode 44*a* extends from the vicinity of the stem pin 6*a* side edge of the substrate 41 to a border line BLa between the surface 41*a* and the groove 41*c*. The border line BLa extends in the Y-axis direction, and corresponds to one end in the X-axis direction of the surface 41*a* and to the upper end of the side surface on the source electrode 43*a* side of the groove 41*c*. The lower electrode 44*a* may protrude toward the drain electrode 43*b* beyond the border line BLa. That is, in the present embodiment, the lower electrode 44*a* extends at least to the border line BLa along the X-axis direction.

The lower electrode 44*a* has a lower layer 51*a* (third layer) provided on the substrate 41 (the surface 41*a*), and an upper layer 52*a* (fourth layer) arranged between the lower layer 51*a* and the graphite thin film 42. The lower layer 51*a* and the upper layer 52*a* are provided in that order from the substrate 41 side. The thickness of the lower layer 51*a* is, for example, approximately 0.2 μm, and the thickness of the upper layer 52*a* is, for example, approximately 0.1 μm. The material forming the lower layer 51*a* and the upper layer 52*a* (the lower electrode 44*a*) may be any material so long as an electric current flows through it. For example, it may be a metal such as Pd, Pt, Au, Ni, Co, Cr, Ti, or Al, or it may be semiconductor. In the case, however, where high-speed modulation is required with respect to the light-emission intensity of the graphite thin film 42, it is desirable for the lower electrode 44*a* (the electrode 43) to a metal of low electrical resistance. In the present embodiment, the lower layer 51*a* is formed of Ti (titanium), and the upper layer 52*a* is formed of Pt (platinum). The upper layer 52*a* is bonded to the graphite thin film 42. The lower layer 51*a* and the upper layer 52*a* are maintained at the same potential.

The upper electrode 45*a* is provided on the graphite thin film 42. The upper electrode 45*a* is formed in a rectangular configuration as seen from the Z-axis direction. In the present embodiment, the size (area) of the upper electrode 45*a* as seen from the Z-axis direction is smaller than that of the lower electrode 44*a*. The thickness of the upper electrode 45*a* is, for example, approximately 0.8 μm. The central portion in the Y-axis direction of the upper electrode 45*a* is provided on the supported portion 42*b*, and the portion of the upper electrode 45*a* other than the central portion thereof is provided on the lower electrode 44*a* (see FIG. 1). That is, the central portion in the Y-axis direction of the upper electrode 45*a* is opposite the lower electrode 44*a* via the graphite thin film 42. The portion of the upper electrode 45*a* other than the central portion is provided on the lower electrode 44*a*, whereby the upper electrode 45*a* is electrically connected to the lower electrode 44*a*.

The upper electrode 45*a* extends along the X-axis direction from one end on the stem pin 6*a* side of the graphite thin film 42 to the vicinity of the groove 41*c*. In the present embodiment, one end 44*c* on the groove 41*c* side in the X-axis direction of the lower electrode 44*a* is situated further on the groove 41*c* side than one end 45*c* on the groove 41*c* side in the X-axis direction of the upper electrode 45*a*. That is, as seen from the Z-axis direction, the one end 45*c* located near the groove 41*c* is more spaced away from the groove 41*c* than the one end 44*c* located near the groove 41*c*. The other end on the stein pin 6*a* side of the upper electrode 45*a* is situated further on the groove 41*c* side than the other end on the stem pin 6*a* side of the lower electrode 44*a* (see FIG. 2). The other end of the upper electrode 45*a* and the other end of the lower electrode 44*a* may be situated at substantially the same position in the X-axis direction. In this case, the other end portion of the upper electrode 45*a* and the other end portion of the lower electrode 44*b* may be electrically connected to each other on the outer side in the X-axis direction of the graphite thin film 42. The upper electrode 45*a* may extend in the X-axis direction to the position of the border line BLa. That is, one end 44*c* and one end 45*c* may be situated at substantially the same position in the X-axis direction.

The upper electrode 45*a* has a lower layer 53*a* (first layer) provided on the graphite thin film 42 (the lower electrode 44*a*), a connection layer 54*a* (second layer) provided on the lower layer 53*a*, and an outermost surface layer 55*a* connected to the stem pin 6*a* side bonding wire 7 (the bonding wire 7 connected to the stem pin 6*a*). The lower layer 53*a*, the connection layer 54*a*, and the outermost surface layer 55*a* are provided in that order from the substrate 41 side. That is, the connection layer 54*a* is arranged between the lower layer 53*a* and the outermost surface layer 55*a*, and the outermost surface layer 55*a* is exposed to the exterior of the light-emitting device 4. In the upper electrode 45*a*, the intermediate layer formed by the lower layer 53*a* and the connection layer 54*a* is arranged between the graphite thin film 42 and the outermost surface layer 55*a*. The thickness of the lower layer 53*a* is, for example, approximately 0.2 μm, and the thickness of the connection layer 54*a* is, for example, approximately 0.5 μm. The thickness of the outermost surface layer 55*a* is, for example, approximately 0.5 μm.

As in the case of the lower layer 51*a* and the upper layer 52*a* of the lower electrode 44*a*, the material forming the lower layer 53*a*, the connection layer 54*a*, and the outermost surface layer 55*a* (the upper electrode 45*a*) may be any material so long as an electric current flows through it. The material constituting the upper electrode 45*a* may be a metal such as Pd, Pt, Au, Ni, Co, Cr, Ti, or Al, or semiconductor. In the present embodiment, the material of each layer is selected such that the resistance value of the outermost surface layer 55*a* is smaller than the resistance value of the lower layer 51*a*, that of the upper layer 52*a*, that of the lower layer 53*a*, and that of the connection layer 54*a* (that of intermediate layer). In the present embodiment, in order to satisfy the above-mentioned resistance value relationship, the lower layer 53*a* is faulted of Ti (titanium), the connection layer 54*a* is formed of Pt (platinum), and the outermost surface layer 55*a* is formed of Au (gold).

The drain electrode 43*b* has a lower electrode 44*b* (second electrode) and an upper electrode 45*b* (fourth electrode). The lower electrode 44*b* has a structure similar to that of the lower electrode 44*a*, and the upper electrode 45*b* has a structure similar to that of the upper electrode 45*a*. The lower electrode 44*b* is provided on the surface 41*b*. On the lower electrode 44*b*, there is provided the supported portion 42*b* of the graphite thin film 42. The upper electrode 45*b* is provided on the graphite thin film 42 (the supported portion 42*b*). On the substrate 41, there are provided the lower electrode 44*b*, the graphite thin film 42 (the supported portion 42*b*), and the upper electrode 45*b* in that order from the substrate 41 side. In other words, the upper electrode 45*b* is opposite the lower electrode 44*b* via the graphite thin film 42. The lower electrode 44*b* and the upper electrode 45*b* are electrically connected to each other.

The lower electrode 44*b* extends along the X-axis direction from the vicinity of the stem pin 6*b* side edge of the substrate 41 to the border line BLb between the surface 41*b* and the groove 41*c*. The lower electrode 44*b* may protrude toward the source electrode 43*a* beyond the border line BLb. That is, in the present embodiment, the lower electrode 44*b* extends along the X-axis direction at least to the border line BLb. One end 44*d* on the groove 41*c* side in the X-axis direction of the lower electrode 44*b* is situated further on the groove 41*c* side than one end 45*d* on the groove 41*c* side in the X-axis direction of the upper electrode 45*b*. That is, as seen from the Z-axis direction, the one end 45*d* located near the groove 41*c* is further spaced away from the groove 41*c* than the one end 44*d* located near the groove 41*c*.

In the present embodiment, the light-emitting device 4 is formed in line symmetry with respect to an imaginary center line situated at the center in the X-axis direction and extending in the Y-axis direction. In the light-emitting device 4 according to the present embodiment, the distance between one end 44*c* of the lower electrode 44*a* and one end 44*d* of the lower electrode 44*b* is smaller than the distance between one end 45*c* of the upper electrode 45*a* and one end 45*d* of the upper electrode 45*b*. The distance between the one end 44*c* of the lower electrode 44*a* and the one end 44*d* of the lower electrode 44*b* is substantially equal to the width of the groove 41*c* as seen from the Y-axis direction, and is substantially equal to the length of the bridging portion 42*c* of the graphite thin film 42 in the X-axis direction.

The lower electrode 44*b* has a lower layer 51*b* (third layer) provided on the substrate 41 (the surface 41*b*), and an upper layer 52*b* (fourth layer) arranged between the lower layer 51*b* and the graphite thin film 42. The lower layer 51*b* is of a structure similar to that of the lower layer 51*a* of the lower electrode 44*a*, and the upper layer 52*b* is of a structure similar to that of the upper layer 52*a* of the lower electrode 44*a*. The material forming the lower layer 51*b* is the same as the material forming the lower layer 51*a*, and the material forming the upper layer 52*b* is the same as the material forming the upper layer 52*a*.

The upper electrode 45*b* has a lower layer 53*b* (first layer) provided on the graphite thin film 42 (the lower electrode 44*b*), a connection layer 54*b* (second layer) provided on the lower layer 53*b*, and an outermost surface layer 55*b* connected to the stem pin 6*b* side bonding wire 7 (the bonding wire 7 connected to the stem pin 6*b*). In the upper electrode 45*b*, the intermediate layer formed by the lower layer 53*b* and the connection layer 54*b* is arranged between the graphite thin film 42 and the outermost surface layer 55*b*. The lower layer 53*b* is of a structure similar to that of the lower layer 53*a* of the upper electrode 45*a*, and the connection layer 54*b* is of a structure similar to that of the connection layer 54*a* of the upper electrode 45*a*. The outermost surface layer 55*b* is of a structure similar to that of the outermost surface layer 55*a* of the upper electrode 45*a*. The material forming the lower layer 53*b* is the same as the material forming the lower layer 53*a*. The material forming the connection layer 54*b* is the same as the material forming the connection layer 54*a*. The material forming the outermost surface layer 55*b* is the same as the material forming the outermost surface layer 55*a*.

Next, an example of the method of manufacturing the light-emitting device 4 will be described. First, there is prepared a silicon substrate (the substrate 41) having a groove of a desired size and coated with an insulator layer. Subsequently, the groove portion is masked, and a foundation electrode (the lower electrodes 44*a* and 44*b*) are evaporated on the surface (the surfaces 41*a* and 41*b*) in which the groove is formed. Then, the graphite thin film 42 floating in a solution such as water is scooped up by the silicon substrate on which the foundation electrode has been evaporated, whereby the graphite thin film 42 is transferred to the silicon substrate. Subsequently, electrodes (the upper electrodes 45*a* and 45*b*) are further evaporated on the silicon substrate to which the graphite thin film 42 has been transferred in such a way as to cover a part of the foundation electrode and of the graphite thin film 42. Through the above process, the light-emitting device 4 is produced, and the light-emitting device 4 thus produced is arranged in the inner space S of the package 2, whereby the light source apparatus 1 is formed.

Figure 4:
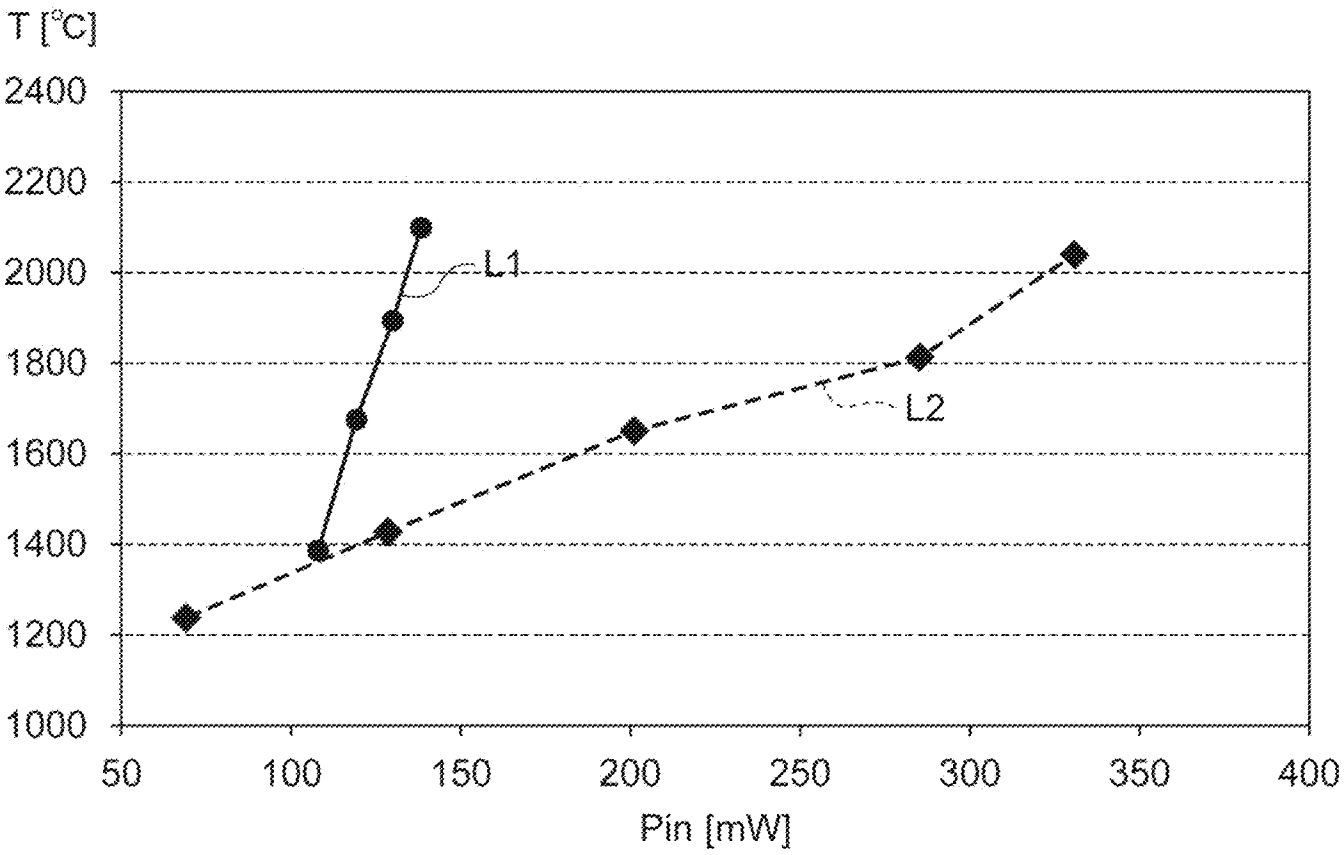
FIG. 4 is a diagram illustrating the measurement result of temperature characteristics when an electric current is caused to flow through the light-emitting device shown in FIG. 1.
Figure 5A:
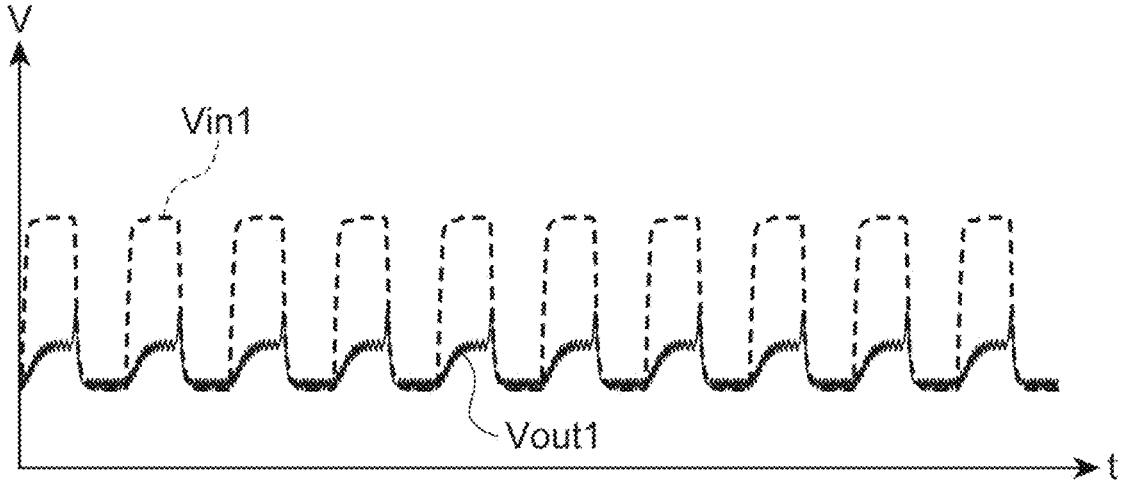
FIG. 5A is a diagram illustrating the measurement result of the response characteristics of the light-emitting device shown in FIG. 1.
Figure 5B:
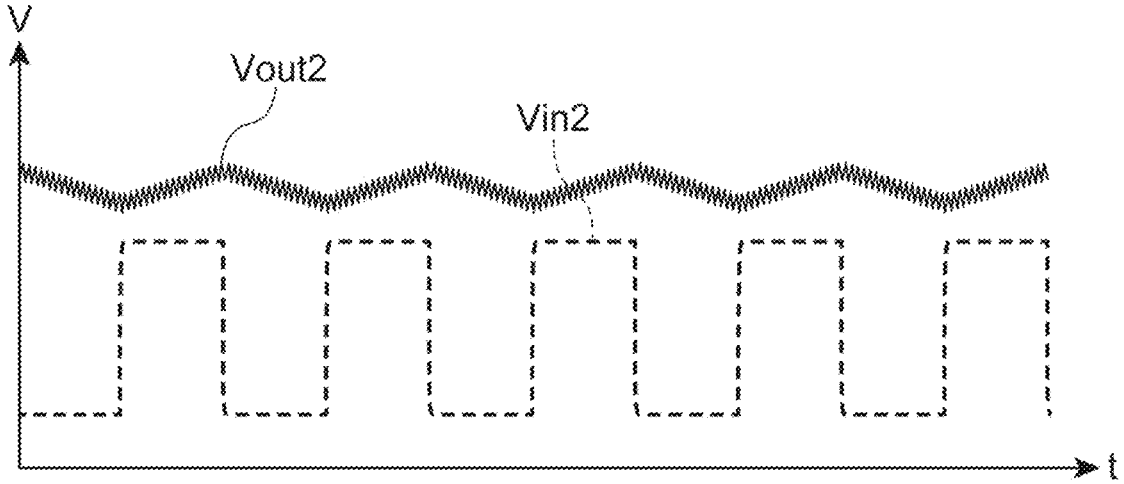
FIG. 5B is a diagram illustrating the measurement results of the response characteristics of a comparative example.
Figure 6:
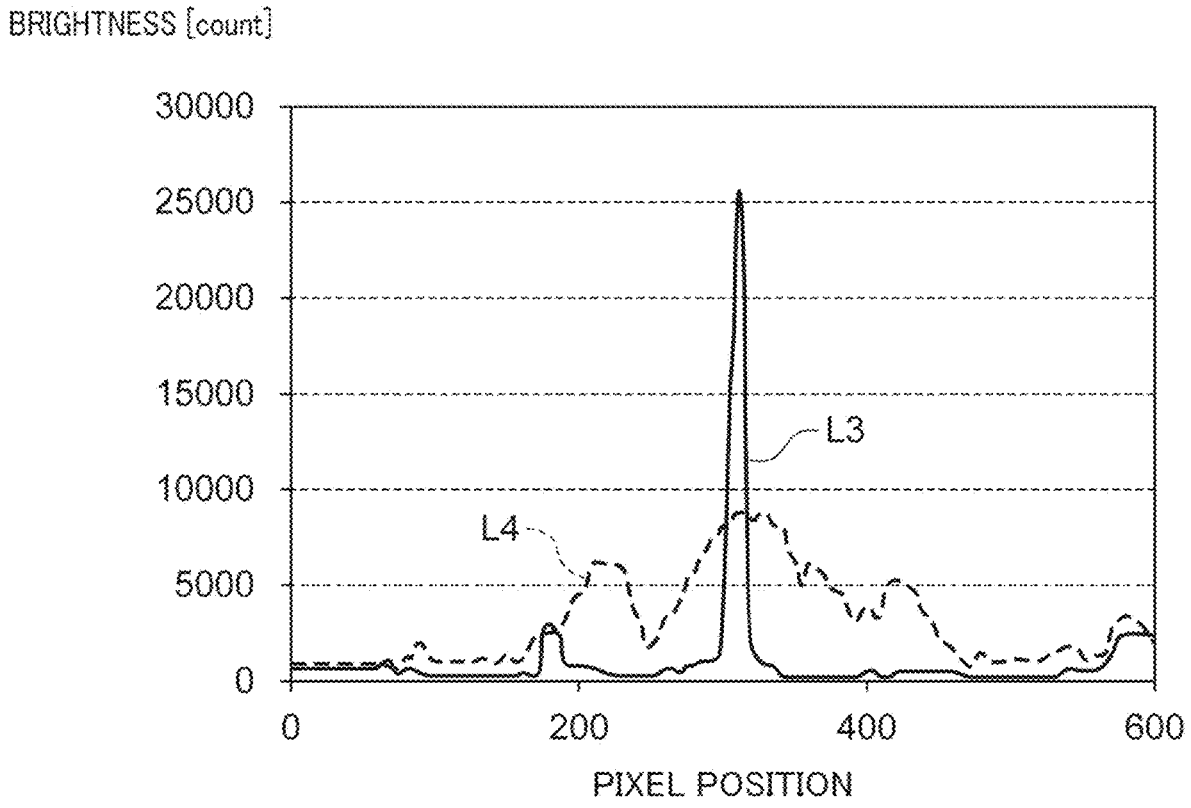
FIG. 6 is a diagram illustrating the measurement result of the brightness distribution of the light-emitting device shown in FIG. 1.

Next, the measurement result of the characteristics of the light-emitting device 4 (the light source apparatus 1) according to the present embodiment will be described with reference to FIGS. 4 through 6. FIG. 4 is a diagram showing the temperature characteristic measurement result when an electric current is caused to flow through the light-emitting device 4 shown in FIG. 1. FIG. 5A is a diagram showing the response characteristic measurement result of the light-emitting device 4 shown in FIG. 1. FIG. 5B is a diagram showing the response characteristic measurement result of a comparative example. FIG. 6 is a diagram showing the brightness distribution measurement result of the light-emitting device 4 shown in FIG. 1.

In the characteristics measurement of the light-emitting device 4, there was used a light-emitting device 4 in which a graphite thin film 42 having a width of 100 μm was provided on an SiO2/Si substrate (a silicon substrate coated with SiO2) one side of which has a length of 5 mm. A groove having a width of 100 μm and a depth of 400 μm was formed in the SiO2/Si substrate. As the graphite thin film 42, a multilayer (approximately 1000 layer) graphene was employed. As the comparative example, there was used a miniature light bulb (light-emitting device) the filament of which is formed of tungsten.

FIG. 4 shows the measurement result of the temperature T of the light-emitting device in the case where the input power Pin was varied. In FIG. 4, the abscissa indicates the input power Pin (milliwatt; mW) input to the light-emitting device, and the ordinate indicates the temperature T (° C.) of the light-emitting device. The temperature T of the light-emitting device was measured by using a pyrometer. In FIG. 4, as compared with the measurement result L2 showing the temperature change in the comparative example, the measurement result L1 showing the temperature change in the light-emitting device 4 shows that the temperature of the light-emitting device 4 rose to high temperature within a range in which the input power Pin is small. Thus, it can be seen that, as compared with the comparative example, the light-emitting device 4 is capable of temperature rise with low power consumption. The temperature T measured in this measurement result corresponds to the brightness from the light-emitting device. That is, it shows that the higher the temperature T of the light-emitting device, the higher the brightness of the light emitted from the light-emitting device.

FIGS. 5A and 5B show the response characteristic of the light-emitting device in the case where an input voltage of a predetermined frequency was input to the light-emitting device. In FIGS. 5A and 5B, the abscissa indicates time, and the ordinate indicates voltage. The input voltage Vin1 of FIG. 5A is a rectangular wave voltage of approximately 1 kHz input to the light-emitting device 4. A voltage Vout1, which is the response result, is the voltage output from an infrared light detection device when the light emitted from the light-emitting device 4 is detected by using the infrared light detection device. As the infrared light detection device, there was employed a photovoltaic device equipped with an InAsSb photo diode provided with a PN junction portion formed by InAsSb (indium arsenic antimony). The input voltage Vin2 of FIG. 5B is a rectangular wave voltage of approximately 50 Hz input to the miniature light bulb of the comparative example. Like the voltage Vout1, the voltage Vout2, which is the response result, is the voltage output from the infrared light detection device when the light emitted from the light-emitting device of the comparative example is detected. FIGS. 5A and 5B show the time change of the voltages Vout1 and Vout2 obtained by observing the output of the infrared light detection device with an oscilloscope. As shown in FIG. 5A, in the light-emitting device 4, there was obtained a response result following the change in the input voltage Vin1. On the other hand, as shown in FIG. 5B, regarding the miniature light bulb of the comparative example, there was input to the miniature light bulb of the comparative example the input voltage Vin2 which was of lower frequency than the input voltage Vin1 input in the light-emitting device 4, and there was obtained a result not following the change in the input voltage Vin2. It can be seen from these results that as compared with the miniature light bulb of the comparative example, the light-emitting device 4 has a response characteristic to follow the input at higher speed.

FIG. 6 shows the brightness distribution obtained from image data related to the respective light-emitting portions of the light-emitting device 4 and the comparative example consisting of a miniature light bulb. In gaining the image data, there was used a CCD camera exhibiting high sensitivity in the range from visible light to near infrared light. Regarding the brightness distribution of the light-emitting device 4, the brightness value (count value) was gained from the image data at the position along the graphite thin film 42. Regarding the brightness distribution of the miniature light bulb of the comparative example, the brightness value was gained from the image data passing through the center of the miniature light bulb of the comparative example in front view. In FIG. 6, the abscissa indicates pixel position, and the ordinate indicates brightness value. According to the pixel position, the portion concerned of the light-emitting device is specified. The brightness value is a value obtained through the observation of the light-emitting portion in the image data obtained by the above-mentioned CCD camera. It is shown that the higher the brightness value of a pixel position, the more intense the light emitted from the corresponding light-emitting portion. It can be seen from the measurement result L3 of the light-emitting device 4 that the light-emitting device 4 emits locally intense light. In contrast, the measurement result L4 of the miniature light bulb of the comparative example shows that light is emitted from the miniature light bulb of the comparative example in a relatively wide range. From these results, it can be seen that the light-emitting device 4 is a device emitting light with high brightness at a minute point.

In the above-described light-emitting device 4, the graphite thin film 42 is provided on the surface 41*a* and the surface 41*b* respectively situated on either side of the groove 41*c* via the lower electrode 44*a* and the lower electrode 44*b* in such a way as to be astride the groove 41*c* formed in the substrate 41. Further, at least a part of the supported portion 42*a* and the supported portion 42*b* of the graphite thin film 42 is covered with the upper electrode 45*a* and the upper electrode 45*b*. In this structure, an electric current flows the graphite thin film 42 mainly from one end 44*c* of the lower electrode 44*a* and one end 45*c* of the upper electrode 45*a* to one end 44*d* of the lower electrode 44*b* and one end 45*d* of the upper electrode 45*b*, so that the electric current mainly flows through the bridging portion 42*c* and the portion in the vicinity of the bridging portion 42*c* of the graphite thin film 42. In some cases, the graphite thin film 42 contains a gas. For example, when the graphite thin film 42 is formed by multilayers of graphene, there are cases in which a gas is contained between the graphene layers (carbon films). In the structure of the light-emitting device 4 of the present embodiment, the upper electrodes 45*a* and 45*b* cover the upper surface of the graphite thin film 42. Due to this structure, at the surface of the graphite thin film 42 (the surface of the portion other than the bridging portion 42*c* exposed to the exterior (the supported portions 42*a* and 42*b*)), the emission of the gas contained in the graphite thin film 42 is suppressed. As a result, it is possible to reduce the influence of the emission gas from the graphite thin film 42 and to efficiently heat the light-emitting portion (the bridging portion 42*c*) of the graphite thin film 42.

Further, the lower electrode 44*a* extends at least to the border line BLa between the surface 41*a* and the groove 41*c*, and the lower electrode 44*b* extends at least to the border line BLb between the surface 41*b* and the groove 41*c*. In this structure, an electric current flows mainly through the bridging portion 42*c* of the graphite thin film 42. As a result, it is possible to heat the bridging portion 42*c* of the graphite thin film 42 more efficiently.

One end 44*c* of the lower electrode 44*a* is situated further on the groove 41*c* side than one end 45*c* of the upper electrode 45*a*, and one end 44*d* of the lower electrode 44*b* is situated further on the groove 41*c* side than one end 45*d* of the upper electrode 45*b*. In this structure, the distance between the lower electrode 44*a* and the lower electrode 44*b* via the graphite thin film 42 is shorter than the distance between the upper electrode 45*a* and the upper electrode 45*b* via the graphite thin film 42. As a result, the magnitude relationship is adjusted between the value of the electric current flowing between the lower electrode 44*a* and the lower electrode 44*b* via the graphite thin film 42 and the value of the electric current flowing between the upper electrode 45*a* and the upper electrode 45*b* via the graphite thin film 42.

The adjustment of the magnitude relationship between the electric current values will be described in detail. The connection with the bonding wire 7 for supplying electric current to the light-emitting device 4 from the exterior (e.g., the contact resistance) is taken into consideration, and the resistance value of the outermost surface layers 55*a* and 55*b* of the upper electrodes 45*a* and 45*b* is smaller than the resistance value of the intermediate layers (the lower layers 53*a* and 53*b* and the connection layers 54*a* and 54*b*) of the upper electrodes 45*a* and 45*b* and that of the lower electrodes 44*a* and 44*b*. From the above-mentioned resistance value relationship, it is easier for the electric current to flow between the outermost surface layers 55*a* and 55*b* (between the upper electrodes 45*a* and 45*b*) than to flow between the lower electrodes 44*a* and 44*b*. On the other hand, the distance between the lower electrodes 44*a* and 44*b* is shorter than the distance between the upper electrodes 45*a* and 45*b*, whereby the resistance value between the lower electrodes 44*a* and 44*b* via the graphite thin film 42 is smaller than the resistance value between the upper electrodes 45*a* and 45*b* via the graphite thin film 42. That is, due to this magnitude relationship in resistance value, the electric current flows easier between the lower electrodes 44*a* and 44*b* than between the upper electrodes 45*a* and 45*b*. Thus, the distance between the lower electrodes 44*a* and 44*b* is made shorter than the distance between the upper electrodes 45*a* and 45*b*, whereby it is possible to balance the ease of flow of the electric current between the outermost surface layers 55*a* and 55*b* (between the upper electrodes 45*a* and 45*b*) and the ease of flow of the electric current between the lower electrodes 44*a* and 44*b*. As a result, it is possible to cause an electric current to flow substantially uniformly from above and below through the portion of the graphite thin film 42 between the lower electrodes 44*a*, 44*b* and the upper electrodes 45*a*, 45*b* (i.e., the bridging portion 42*c* and the portion in the vicinity thereof).

The substrate 41 has a base member 41*d* formed of silicon, and an insulator layer 41*e* formed of a material containing an oxide. The insulator layer 41*e* is arranged between the lower electrodes 44*a*, 44*b* and the base member 41*d*. In this structure, due to the insulator layer 41*e*, it is possible to secure insulation between the source electrode 43*a* (the lower electrode 44*a*) and the drain electrode 43*b* (the lower electrode 44*b*) via the base member 41*d*. That is, it is possible to suppress short-circuiting between the lower electrode 44*a* and the lower electrode 44*b* via the base member 41*d*.

In the upper electrodes 45*a* and 45*b*, the outermost surface layers 55*a* and 55*b* are formed of gold, the lower layers 53*a* and 53*b* are formed of titanium, and the connection layers 54*a* and 54*b* are formed of platinum. In this way, the lower layers 53*a* and 53*b* are formed of titanium, whereby it is possible to reduce the contact resistance between the graphite thin film 42 and the source electrode 43*a* and the drain electrodes 43*b* (the upper electrodes 45*a* and 45*b*). Further, due to the intermediation of the connection layers 54*a* and 54*b* formed of platinum, it is possible to achieve an improvement in the bonding property of the outermost surface layers 55*a* and 55*b* with respect to the lower layers 53*a* and 53*b*.

In the lower electrodes 44*a* and 44*b*, the lower layers 51*a* and 51*b* are formed of titanium, and the upper layer 52*b* is formed of platinum. For example, when the graphite thin film 42 floating in a solution such as water is transferred by using a substrate 41 onto which a lower electrode consisting solely of titanium is evaporated, there is a risk of oxidation of the lower electrode (titanium). In contrast, the upper layers 52*a* and 52*b* formed of platinum are arranged on the lower layers 51*a* and 51*b*, so that, when transferring the graphite thin film 42 to the substrate 41, it is possible to suppress oxidation of the lower electrodes 44*a* and 44*b*. Further, the lower layers 51*a* and 51*b* are formed of titanium, which has a high affinity for SiO2, whereby it is possible to achieve an improvement in the bonding property of the lower electrodes 44*a* and 44*b* with respect to the insulator layer 41*e* (SiO2) constituting the surfaces 41*a* and 41*b* of the substrate 41.

In the light source apparatus 1, the light-emitting device 4 is arranged in the inner space S of the package 2 maintained in a vacuum state. Due to the above-described structure of the light-emitting device 4, the gas emitted from the graphite thin film 42 is suppressed, so that it is possible to reduce the possibility of the degree of vacuum of the inner space S being reduced by the emission gas. As a result, the degree of vacuum of the inner space S is maintained, and deterioration in light-emission efficiency can be suppressed.

An embodiment of the present invention has been described, but the present invention is not restricted to the embodiment described above and allows various modifications without departing from the scope of the gist of the invention.

For example, the lower electrode 44*a* may not extend to the boundary line BLa along the X-axis direction. That is, as seen from the Z-axis direction, one end 44*c* of the lower electrode 44*a* may be situated on the stem pin 6*a* side of the boundary line BLa. The lower electrode 44*b* may not extend along the X-axis direction to the border line BLb. That is, as seen from the Z-axis direction, one end 44*d* of the lower electrode 44*b* may be situated on the stem pin 6*b* side of the border line BLb.

The light-emitting device 4 may be equipped with a plurality of graphite thin films 42. For example, a plurality of graphite thin films 42 may be arranged side by side in the Y-axis direction (the extending direction of the groove 41*c*).

In this case, the respective supported portions 42*a* and 42*b* of the plurality of graphite thin films 42 are covered with the source electrode 43*a* and the drain electrode 43*b*. The size (area) of the lower electrodes 44*a* and 44*b* may be the same as the size of the upper electrodes 45*a* and 45*b* or may be smaller than the size of the upper electrodes 45*a* and 45*b*. The length in the X-axis direction of the lower electrodes 44*a* and 44*b* may be the same as the length in the X-axis direction of the upper electrodes 45*a* and 45*b* or may be shorter than the length in the X-axis direction of the upper electrodes 45*a* and 45*b*.

The configuration of the groove 41*c* as seen from the Y-axis direction is not restricted to the rectangular one. The groove 41*c* may be of any other configuration such as an elliptical configuration. The insulator layer 41*e* may not be provided on the surface of the groove 41*c*. The light-emitting device 4 may not be of a structure that is line-symmetrical with respect to an imaginary line extending along the Y-axis direction. The material of each layer (e.g., the lower layer 51*a*) constituting the source electrode 43*a* may be different from the material of each layer (e.g., the lower layer 51*b*) constituting the drain electrode 43*b*.

What is claimed is:

1. A light-emitting device comprising:

a substrate having a groove extending in a first direction and a first surface and a second surface respectively arranged to sandwich the groove in a second direction crossing the first direction;

a first electrode provided on the first surface;

a second electrode provided on the second surface;

a graphite thin film provided on the first electrode and the second electrode and extending from the first electrode to the second electrode along the second direction in such a way as to be astride the groove;

a third electrode electrically connected to the first electrode and provided on the graphite thin film in such a way as to be opposite the first electrode via the graphite thin film; and a fourth electrode electrically connected to the second electrode and provided on the graphite thin film in such a way as to be opposite the second electrode via the graphite thin film.

2. The light-emitting device according to claim 1, wherein the graphite thin film is multilayer graphene the number of layers of which ranges from 50 to 2000.

3. The light-emitting device according to claim 1, wherein one end on the groove side of the first electrode is situated further on the groove side than one end on the groove side of the third electrode; and one end on the groove side of the second electrode is situated further on the groove side than one end on the groove side of the fourth electrode.

4. The light-emitting device according to claim 1, wherein the first electrode extends at least to a border line between the first surface and the groove; and the second electrode extends at least to a border line between the second surface and the groove.

5. The light-emitting device according to claim 1, wherein the substrate has a base member formed of silicon, and an oxide layer formed of a material containing an oxide; and the oxide layer is arranged at least between the base member and the first electrode and between the base member and the second electrode.

6. The light-emitting device according to claim 1, wherein the third electrode and the fourth electrode respectively have an outermost surface layer, and an intermediate layer arranged between the outermost surface layer and the graphite thin film; and the resistance value of the outermost surface layer is smaller than the resistance value of the intermediate layer, the first electrode, and the second electrode.

7. The light-emitting device according to claim 6, wherein the outermost surface layer is formed of gold;

the intermediate layer includes a first layer formed of titanium and a second layer formed of platinum;

the first layer is provided on the graphite thin film; and the second layer is arranged between the first layer and the outermost surface layer.

8. The light-emitting device according to claim 1, wherein the first electrode and the second electrode respectively have a third layer formed of titanium and a fourth layer formed of platinum;

the third layer is provided on the substrate; and the fourth layer is arranged between the third layer and the graphite thin film.

9. A light source apparatus comprising: a light-emitting device according to claim 1; and a package having a light-transmitting window and forming an inner space maintained in a vacuum state, wherein the light-emitting device is arranged in the inner space of the package.

* * * * *